US007818839B2

(12) United States Patent
Koch et al.

(10) Patent No.: US 7,818,839 B2
(45) Date of Patent: Oct. 26, 2010

(54) PATIENT BED FOR AN OPERATING TABLE

(75) Inventors: Guido Koch, Karlsruhe (DE); Heiko Kottmann, Rastatt (DE); Markus Bürstner, Karlsruhe (DE)

(73) Assignee: Maquet GmbH & Co. KGaA, Rastatt (DE)

( * ) Notice: Subject to any disclaimer, the term of this patent is extended or adjusted under 35 U.S.C. 154(b) by 751 days.

(21) Appl. No.: 11/598,597

(22) Filed: Nov. 13, 2006

(65) Prior Publication Data

US 2007/0107129 A1 May 17, 2007

(30) Foreign Application Priority Data

Nov. 14, 2005 (DE) ..... 10 2005 054 174

(51) Int. Cl.
*A61G 13/08* (2006.01)
*A61G 13/04* (2006.01)

(52) U.S. Cl. ..... 5/613; 5/616; 5/610

(58) Field of Classification Search ..... 5/600, 5/608, 610, 613, 616–618
See application file for complete search history.

(56) References Cited

U.S. PATENT DOCUMENTS 0,566,521 A 8/1896 Leger
1,740,906 A 12/1929 Rothauszky et al.
2,416,410 A 2/1943 Shampaine (Continued)

FOREIGN PATENT DOCUMENTS

DE 264297 8/1912

(Continued)

OTHER PUBLICATIONS

European Search Report for Serial No. EP 06 12 3443 dated Feb. 7, 2007.

(Continued)

*Primary Examiner*—Robert G Santos
(74) *Attorney, Agent, or Firm*—McCormick, Paulding & Huber LLP

(57) ABSTRACT

In a patient bed for an operating table, comprising a plurality of bed portions (18, 32, 70, 72), of which a middle portion (18) is designed for connection to the supporting column of the operating table and which are coupled releasably to one another via interfaces (30, 68), at least one bed portion (70, 72) being adjustable in relation to an adjacent bed portion (32) in the region of an interface (68), the middle portion (18) of the bed (16) is connectable at at least one of its ends, via a first interface (30), to the one end of an intermediate portion (32) which is connectable at its other end, via a second interface (68), to a further bed portion (70, 72), the first interface (30) having two first coupling elements (34, 36) which engage positively one in the other for a rigid connection and which have transmission elements coming into contact with one another during interengagement and intended for the transmission of signals and/or energy, and the second interface (68) comprising two second coupling elements which are intended for positive engagement with one another and of which the second coupling element (74) arranged on the intermediate portion (32) can be adjusted, by means of an actuating drive arranged on the intermediate portion, about an axis parallel to the bed plane and perpendicular to the bed longitudinal direction.

9 Claims, 7 Drawing Sheets

U.S. PATENT DOCUMENTS

| | | | | |
|---|---|---|---|---|
| 2,763,320 | A | | 9/1956 | Schram |
| 2,764,459 | A | | 9/1956 | McDonald |
| 2,771,330 | A | | 11/1956 | Zaalberg |
| 2,775,496 | A | | 12/1956 | Berggren |
| 2,816,806 | A | | 12/1957 | Zaalberg |
| 2,995,762 | A | | 8/1961 | Albinson |
| 3,226,734 | A | | 1/1966 | Coventon |
| 3,238,539 | A | | 3/1966 | Koch |
| 3,302,218 | A | | 2/1967 | Stryker |
| 3,328,079 | A | | 6/1967 | Byczkowski et al. |
| 3,362,704 | A | | 1/1968 | Pilz |
| 3,379,877 | A | | 4/1968 | Makino et al. |
| 3,388,700 | A | | 6/1968 | Mountz |
| 3,868,103 | A | | 2/1975 | Pageot et al. |
| 4,101,120 | A | * | 7/1978 | Seshima ..... 5/616 |
| 4,176,415 | A | * | 12/1979 | Dickerson et al. ..... 5/614 |
| 4,244,358 | A | | 1/1981 | Pyers |
| 4,597,119 | A | | 7/1986 | Padgett |
| 4,640,482 | A | | 2/1987 | Rogers |
| 4,768,241 | A | | 9/1988 | Beney |
| 5,031,547 | A | | 7/1991 | Hirose |
| 5,083,331 | A | | 1/1992 | Schnelle et al. |
| 5,220,698 | A | | 6/1993 | Hannant |
| 5,277,427 | A | | 1/1994 | Bryan et al. |
| 5,279,011 | A | * | 1/1994 | Schnelle ..... 5/616 |
| 5,477,570 | A | | 12/1995 | Hannant et al. |
| 5,544,376 | A | | 8/1996 | Fromson |
| 5,564,852 | A | | 10/1996 | Maxwell et al. |
| 5,611,638 | A | | 3/1997 | Dorr et al. |
| 5,615,431 | A | | 4/1997 | Vassilli |
| 5,621,932 | A | | 4/1997 | Strachan |
| 5,628,078 | A | | 5/1997 | Pennington et al. |
| 5,649,833 | A | * | 7/1997 | Pfeuffer et al. ..... 439/218 |
| 5,651,150 | A | | 7/1997 | Kanitzer et al. |
| 5,659,909 | A | * | 8/1997 | Pfeuffer et al. ..... 5/600 |
| 5,754,997 | A | | 5/1998 | Lussi et al. |
| 5,769,720 | A | | 6/1998 | Aiken et al. |
| 5,787,528 | A | | 8/1998 | Antinori |
| 5,790,996 | A | | 8/1998 | Narfstrom |
| 5,914,796 | A | | 6/1999 | Selin |
| 5,969,488 | A | | 10/1999 | Fromson |
| 6,008,598 | A | | 12/1999 | Luff et al. |
| 6,038,718 | A | | 3/2000 | Pennington et al. |
| 6,073,284 | A | | 6/2000 | Borders |
| 6,095,713 | A | | 8/2000 | Doyle et al. |
| 6,351,678 | B1 | | 2/2002 | Borders |
| 6,390,927 | B1 | | 5/2002 | Cleveland, III |
| 6,396,224 | B1 | | 5/2002 | Luff et al. |
| 6,484,334 | B1 | | 11/2002 | Borders et al. |
| 6,539,028 | B1 | | 3/2003 | Soh et al. |
| 6,560,492 | B2 | | 5/2003 | Borders |
| 6,565,156 | B1 | | 5/2003 | Yamashita et al. |
| 6,609,260 | B2 | | 8/2003 | Hand et al. |
| 6,619,872 | B2 | | 9/2003 | Crorey et al. |
| 6,634,202 | B1 | | 10/2003 | Oetiker |
| 6,722,289 | B2 | | 4/2004 | Kato |
| 6,862,761 | B2 | | 3/2005 | Hand et al. |
| 6,971,131 | B2 | * | 12/2005 | Bannister ..... 5/616 |
| 6,986,179 | B2 | | 1/2006 | Varadharajulu |
| 7,010,369 | B2 | | 3/2006 | Borders et al. |
| 7,068,143 | B2 | | 6/2006 | Doering et al. |
| 7,089,612 | B2 | | 8/2006 | Rocher et al. |
| 7,154,397 | B2 | | 12/2006 | Zerhusen et al. |
| 7,181,791 | B2 | | 2/2007 | Clayton |
| 7,210,201 | B2 | | 5/2007 | Maeckle et al. |
| 7,235,942 | B2 | | 6/2007 | Nagoaka et al. |
| 7,321,811 | B1 | | 1/2008 | Rawls-Meehan |
| 7,346,944 | B2 | | 3/2008 | Shaw |
| 7,367,740 | B2 | | 5/2008 | Lazic et al. |
| 7,398,790 | B2 | | 7/2008 | Glatz |
| 7,412,736 | B2 | | 8/2008 | Hyre et al. |
| 7,526,823 | B2 | | 5/2009 | Koch |
| 7,634,826 | B2 | | 12/2009 | Koch |
| 7,669,258 | B2 | | 3/2010 | Koch |
| 7,694,366 | B2 | | 4/2010 | Koch et al. |
| 2002/0014951 | A1 | | 2/2002 | Kramer et al. |
| 2002/0111701 | A1 | | 8/2002 | Borders |
| 2002/0170115 | A1 | | 11/2002 | Borders et al. |
| 2003/0078144 | A1 | | 4/2003 | Gehrke |
| 2003/0090387 | A1 | | 5/2003 | Lestienne et al. |
| 2003/0195644 | A1 | | 10/2003 | Borders et al. |
| 2004/0006821 | A1 | | 1/2004 | Hand et al. |
| 2004/0074003 | A1 | * | 4/2004 | Bannister ..... 5/616 |
| 2004/0172757 | A1 | | 9/2004 | Somasundaram |
| 2007/0056105 | A1 | | 3/2007 | Hyre et al. |
| 2007/0101497 | A1 | | 5/2007 | Revenus |
| 2007/0101500 | A1 | | 5/2007 | Fruh et al. |
| 2007/0107123 | A1 | | 5/2007 | Koch |
| 2007/0107124 | A1 | | 5/2007 | Koch |
| 2007/0107125 | A1 | | 5/2007 | Koch |
| 2007/0107126 | A1 | | 5/2007 | Koch |
| 2007/0107129 | A1 | | 5/2007 | Burstner |
| 2007/0110448 | A1 | | 5/2007 | Ruch |
| 2007/0116512 | A1 | | 5/2007 | Katzenstein |
| 2007/0118989 | A1 | | 5/2007 | Koch |
| 2009/0119842 | A1 | | 5/2009 | Koch |
| 2010/0107340 | A1 | | 5/2010 | Koch et al. |

FOREIGN PATENT DOCUMENTS

| | | | |
|---|---|---|---|
| DE | 4229318 | C1 | 9/1993 |
| DE | 296 10 726 | U1 | 9/1996 |
| DE | 19732467 | A1 | 2/1999 |
| DE | 197 51 320 | A1 | 5/1999 |
| DE | 19748367 | A1 | 5/1999 |
| DE | 19751329 | A1 | 5/1999 |
| DE | 19919496 | A1 | 11/2000 |
| DE | 102 53 878 | A1 | 5/2004 |
| DE | 102 53 906 | A1 | 6/2004 |
| EP | 0 457 246 | A1 | 11/1991 |
| EP | 0625348 | A1 | 11/1994 |
| EP | 0832603 | A1 | 4/1998 |
| EP | 0 913 139 | | 5/1999 |
| FR | 2388546 | | 11/1978 |
| GB | 1 321 193 | | 6/1973 |
| GB | 2260075 | A | 4/1993 |
| GB | 2 277 870 | A | 11/1994 |
| WO | 99 28146 | A1 | 6/1999 |
| WO | 02 055001 | A1 | 7/2002 |
| WO | 03 086263 | A1 | 10/2003 |

OTHER PUBLICATIONS

European Search Report for Serial No. EP 06 12 3596 dated Sep. 7, 2007.

European Search Report for Serial No. EP 06 12 3592 dated Nov. 29, 2007.

European Search Report for Serial No. EP 06 12 3593 dated Dec. 4, 2007.

European Search Report for Application No. EP 06 12 3721, dated Jun. 20, 2008.

European Search Report for Serial No. EP 06 12 3598 dated Feb. 8, 2007.

European Search Report for Application No. EP 06 12 3444, dated Aug. 22, 2008.

European Search Report for Application No. EP 06 12 3719, dated Sep. 7, 2007.

V. Vitsas, et al., Performance Analysis of the Advanced Infrared (Alr) CSMA/CA MAC Protocol for Wireless LANs, Kluwer Academic Publishers, Wireless Networks 9, pp. 495-507.

* cited by examiner

PATIENT BED FOR AN OPERATING TABLE

CROSS REFERENCE TO RELATED APPLICATIONS

Applicant hereby claims foreign priority benefits under U.S.C. 119 from German Patent Application No. 10 2005 054 174.7 filed on Nov. 14, 2005, the contents of which are incorporated by reference herein.

FIELD OF THE INVENTION

The invention relates to a patient bed for an operating table, comprising a plurality of bed portions, of which a middle portion is designed for connection to the supporting column of the operating table and which are coupled releasably to one another via interfaces, at least one bed portion being adjustable in relation to an adjacent bed portion in the region of an interface.

BACKGROUND OF THE INVENTION

Numerous patient beds are known, in which the individual portions or segments are adjustable or pivotable relative to one another. Adjustment may take place manually or else motively. In motive adjustment, the energy for driving the motors has to be conducted via the joints. This makes it difficult to exchange individual bed portions. However, it is precisely the exchange of bed portions which is desirable so that the patient bed can be adapted to different operations and consequently so as to increase the flexibility of the bed system. However, the exchangeability of bed portions also entails the risk that bed portions not intended for interconnection are combined with one another, with the result that either parts of the bed may be damaged or even the patient or the operating personnel is put at risk.

SUMMARY OF THE INVENTION

The object on which the invention is based is to design a patient bed of the type mentioned in the introduction, such that it ensures as high a flexibility as possible and a high degree of handling safety at as low an outlay as possible in technical terms.

This object is achieved, according to the invention, in that the middle portion of the bed is connectable at at least one of its ends, via a first interface, to the one end of an intermediate portion which is connectable at its other end, via a second interface, to a further bed portion, in that the first interface has two first coupling elements which engage positively one in the other for a rigid connection and which have transmission elements coming into contact with one another during interengagement and intended for the transmission of signals and/or energy, and in that the second interface comprises two second coupling elements which are intended for positive engagement with one another and of which the second coupling element arranged on the intermediate portion can be adjusted, by means of an actuating drive arranged on the intermediate portion, about an axis parallel to the bed plane and perpendicular to the bed longitudinal direction.

It has been shown that, for most operations, it is not absolutely necessary for all the bed portions to be motively adjustable in each case in relation to their adjacent bed portion. In the solution according to the invention, the intermediate portion is designed virtually as a drive module. If motive adjustment is required, the intermediate portion is coupled to the middle portion of the bed, drive energy being transmitted via the first interface from the middle portion or from the supporting column via the middle portion. The intermediate portion then contains the actuating drive, by means of which a bed portion coupled to it via the second interface can be adjusted. A transmission of drive energy via the second interface is not required. At the same time, furthermore, there is the possibility of omitting the intermediate portion and of coupling specific bed portions directly to the middle portion of the patient bed.

In order to allow a rapid and reliable coupling at the interfaces, it is expedient if, in the case of both interfaces, in each case one of the coupling elements is provided with at least one hook and the other coupling element with at least one complementary hook receptacle. In order to avoid this hook connection being levered out unintentionally, it is expedient if the coupling elements of the interfaces which are in engagement with one another are interlockable by means of a positive interlock.

In order to ensure that the intermediate portion can be coupled to the middle portion in only one specific position and to avoid coupling together bed portions which are not intended for one another, the coupling elements of the first and of the second interface are not mutually compatible.

In a preferred embodiment of the patient bed according to the invention, a further bed portion, which can be coupled to the intermediate portion via a second interface, is coupleable at its other end, via a third interface, to an accessory part. This third interface may comprise third coupling elements engaging positively one in the other and which ensure reliable coupling.

Preferably, the third coupling elements are designed such that the accessory-side third coupling element is compatible with the first coupling element arranged on the middle portion, and such that the third coupling element arranged on the further bed portion is incompatible with the first coupling element arranged on the intermediate portion. Consequently, although the accessory part can be coupled directly to the middle portion, the intermediate portion and the further bed portion nevertheless cannot be interchanged. Such an interchange could lead to too many and too heavy bed portions being coupled to one another, so that the function and reliability of the patient bed are no longer ensured.

Preferably, the actuating drive on the intermediate portion comprises a threaded worm driven by a motor and a worm wheel driven by the threaded worm, the adjustable second coupling element on the intermediate portion being connected fixedly in terms of rotation to the worm wheel.

A broad diversity of possibilities for setting the patient bed arises in that, in a preferred embodiment of the patient bed according to the invention, the middle portion comprises two segments which are pivotable relative to one another about a pivot axis directed transversely to the longitudinal direction of the bed.

In the solution according to the invention, therefore, the middle portion of the bed has, at at least one of its ends, a first interface at which a second bed element can be attached.

However, this second element may also be a CFRP module permeable to X-rays, an extension appliance or other special accessory which, in view of its requirements, needs no motive adjustability, but, in contrast, a high mechanical load-bearing capacity of the coupling elements. Since no bed joint has to pivot this first interface, these coupling elements may have a highly rigid and load-bearing configuration.

This second element may also be the intermediate portion which is connectable to a further bed element, an actuating drive integrated in the intermediate portion being capable of pivoting the coupleable bed element about an axis parallel to the bed plane and perpendicular to the bed longitudinal direction. For this purpose, the first interface is equipped with energy and signal transmission elements which can come into contact with the first intermediate portion.

BRIEF DESCRIPTION OF THE DRAWINGS

Further features and advantages of the invention may be gathered from the following description which explains the invention by means of an exemplary embodiment, in conjunction with the accompanying drawings in which.

DETAILED DESCRIPTION OF THE INVENTION

Figure 1:
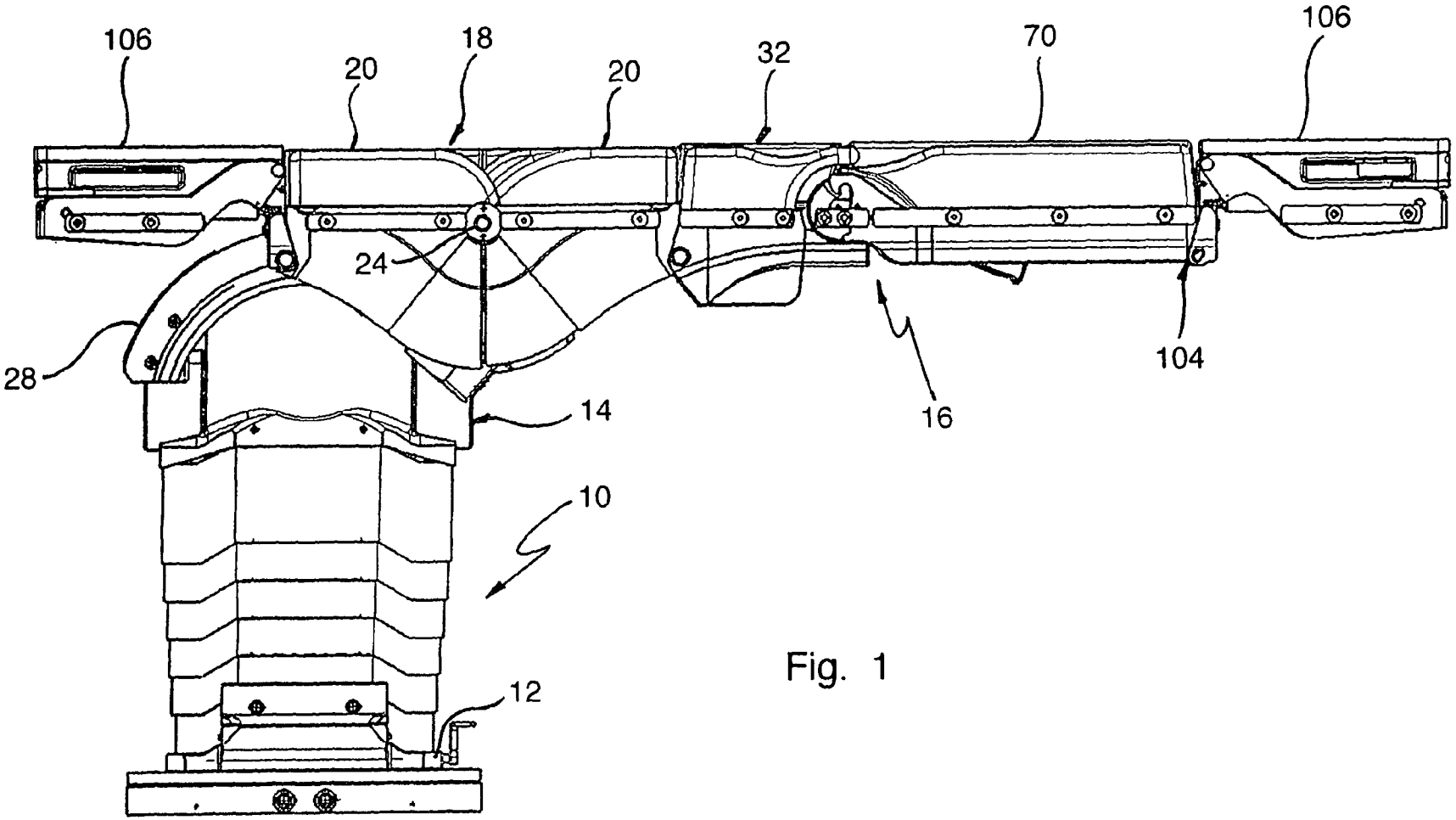
FIG. 1 shows a partially diagrammatic side view of an operating table with a patient bed according to the invention.

The operating table illustrated in FIG. 1 comprises a supporting column 10 with a column foot 12 and with a column head 14, on which a patient bed, designated in general by 16, is supported.

Figure 2:
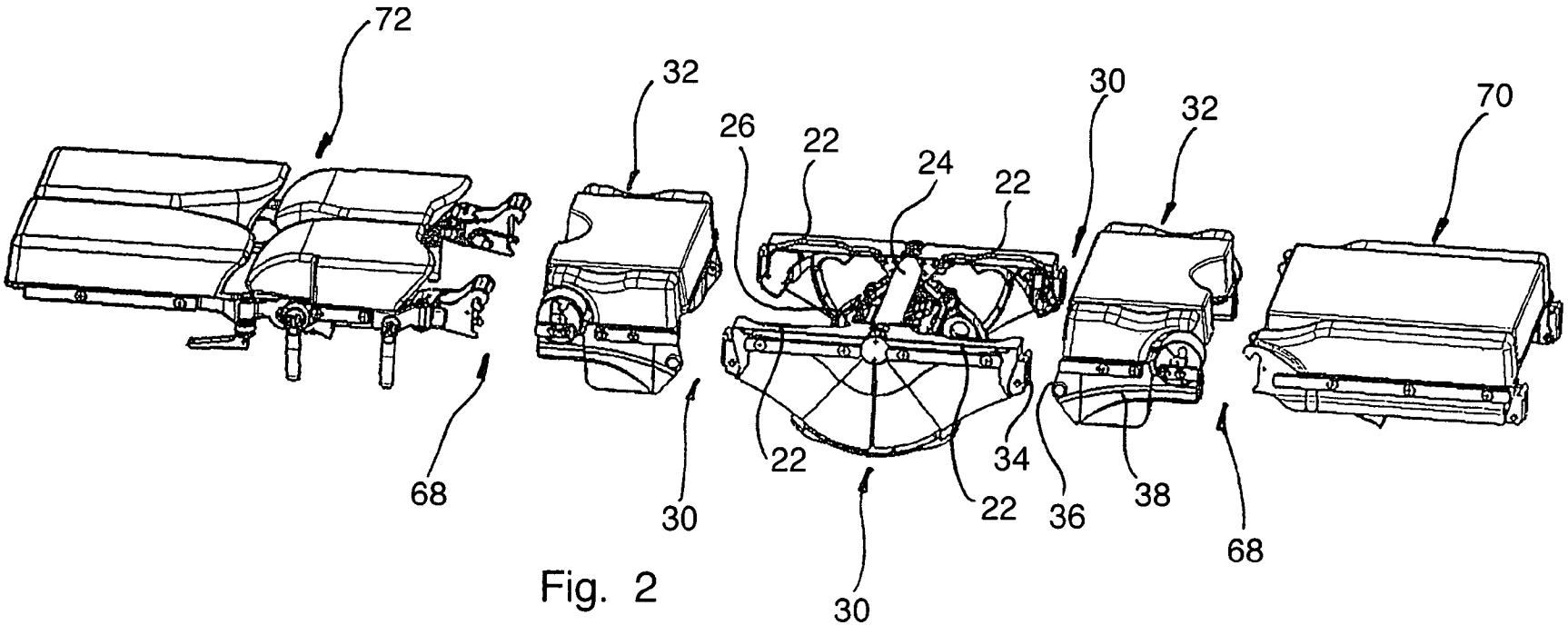
FIG. 2 shows a perspective and partially diagrammatic top view of a bed broken down into its individual bed portions.

The patient bed 16 is composed of a plurality of segments or modules coupled releasably to one another. It comprises, in any event, a middle portion 18 which is constructed from two segments 20 in the exemplary embodiments of the bed 16 which are illustrated in FIGS. 1 and 2. These segments are mounted pivotably with their spars 22 about a common shaft 24 on a connecting frame 26 which is coupleable to a saddle, not illustrated, which is itself movable on a convexly curved guide track 28 of the column head 14. In FIG. 1, this saddle is located near the right-hand end of the guide track 28. The connecting frame 26 carries drive devices, in order to pivot the segments 22 and consequently the entire bed 16 about the axis of the shaft 24. The bed 16 can therefore be inclined in the desired way or else maintain its horizontal position when the saddle is displaced on the guide track 28. The adjustment of the bed 16 as a whole and its connection to the column 10 do not, however, need to be explained in any more detail here.

The middle portion 18 can be coupled at its ends, that is to say at the ends of the spars 22, in each case via a first interface 30, to intermediate portions 32 which are designed as joint modules. The interface 30 comprises in each case first coupling elements 34, 36 which are intended for engagement with one another and which are arranged on the middle portion 18, that is to say on the spars 22 of a segment 20 or on the spars 38, corresponding to them, of the intermediate portion 32, and are illustrated in more detail in FIGS. 3 to 5.

Figure 3:
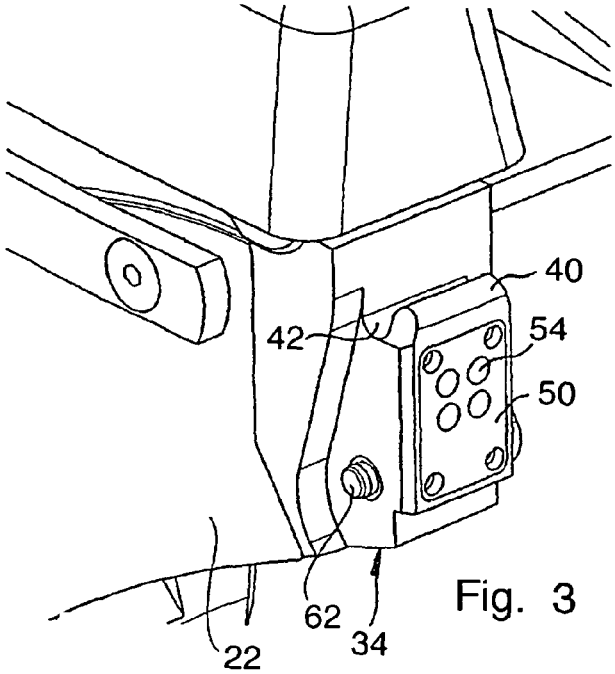
FIG. 3 shows a diagrammatic perspective illustration of a coupling element, arranged on the middle portion, of the first interface.
Figure 4:
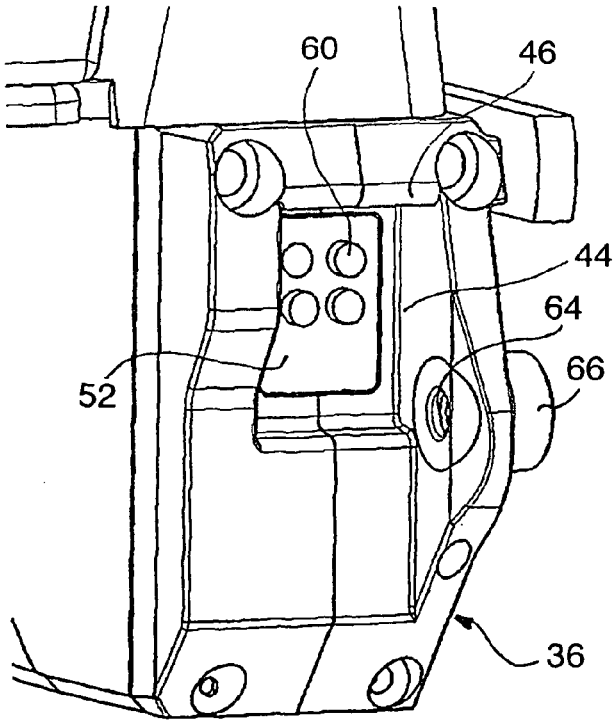
FIG. 4 shows an illustration, corresponding to FIG. 3, of the coupling element, arranged on the intermediate portion, of the first interface.
Figure 5:
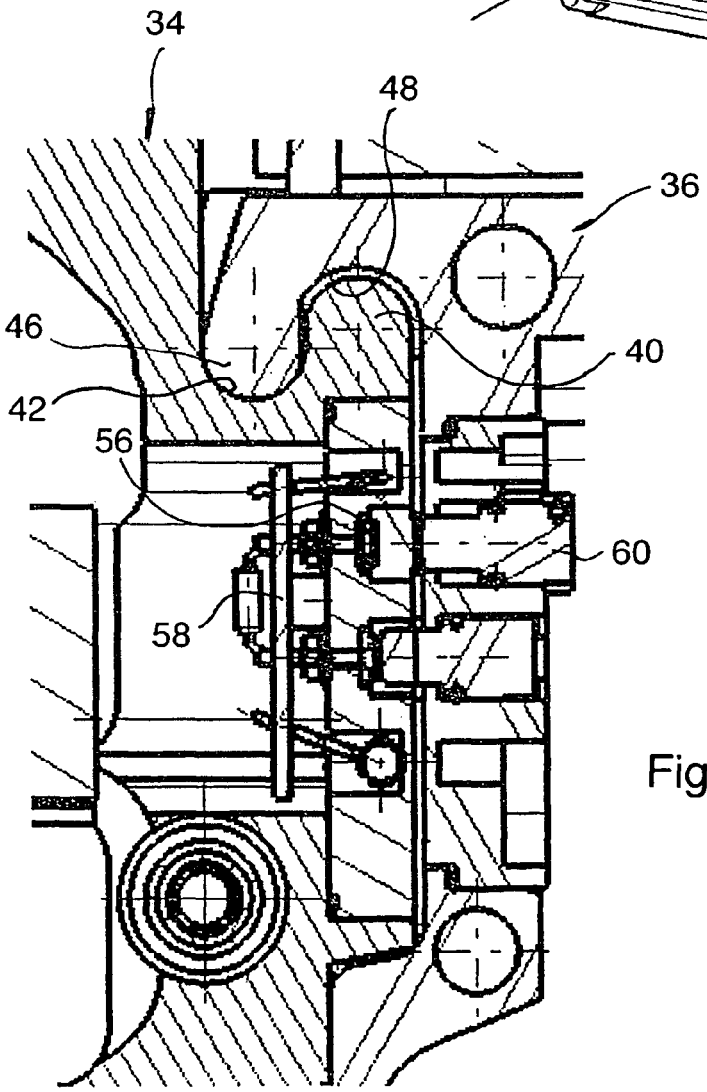
FIG. 5 shows a diagrammatic sectional illustration through the coupling elements of the first interface which are in engagement with one another.

The coupling element 34 illustrated in FIG. 3, which is arranged on the middle portion 18, is of block-shaped design and on its top side has a bead 40, behind which is formed a channel-shaped depression 42. The countercoupling element, illustrated in FIG. 4, of the first interface 30 has a reception pocket 44 for receiving the block-shaped first coupling element 34 and, at the upper edge of this reception pocket 44, a wide hook-shaped bead 46 with a channel 48 lying behind it (FIG. 5). When the first coupling elements 34 and 36 engage one in the other, the bead 40 of the coupling element 34 lies in the channel 48 and the bead 46 in the channel 42, as shown in FIG. 5.

Contact elements for energy and signal transmission are formed on the mutually confronting contact faces 50 and 52 of the two coupling elements 34 and 36. For this purpose, in the contact face 50, reception bores 54 are provided, in which lie contact elements 56 (FIG. 5) which are connected to a circuit board 58. In the countercontact face 52 of the countercoupling element 36, contact pins 60 are mounted resiliently displaceably, which are intended for engagement into the reception bores 54 and for contacting with the contact elements 56, as shown in FIG. 5. Signals and current can consequently be transmitted between the column 10 and the intermediate portions 32 via the middle portion 18.

In the coupling position illustrated in FIG. 5, the coupling elements 34 and 36 can be interlocked by means of a spring-loaded interlocking pin 62 which engages into a clearance 64 in the countercoupling element 36. For uncoupling, this interlocking pin 62 can be pressed in via a pushbutton 66, so that the two coupling elements 34 and 36 can be separated from one another again.

The respective intermediate portion 32 can be coupled at its end facing away from the middle portion 18, via a second interface 68, to a further bed portion 70 (on the right in FIG. 2) or 72 (on the left in FIG. 2). In the exemplary embodiment illustrated, the bed portion 70 is formed by a back plate and the bed portion 72 by a leg plate. The coupling elements of the second interface 68, then, will be explained in more detail with reference to FIGS. 8 to 11. FIGS. 8 to 11 show the coupling elements intended for engagement with one another, in each case in the region of a spar of the bed portions to be connected to one another. The coupling element 74 assigned to the intermediate portion 32 comprises an outer hook receptacle 76 (FIG. 8) and an inner hook receptacle 78 (FIG. 10) which are in each case connected fixedly in terms of rotation to a disc-shaped cover flange 80 and 82 of a cylindrical gear case 82. These cover flanges 80, 82 are connected fixedly in terms of rotation to a worm wheel, not illustrated, which is mounted inside the gear case 84 and which meshes with a gear worm mounted in a housing block 86 and coupled to an electric motor, not illustrated. By the motor being actuated, the hook receptacles 76 and 78 can be rotated jointly about the axis 88 of the worm wheel.

Figure 9:
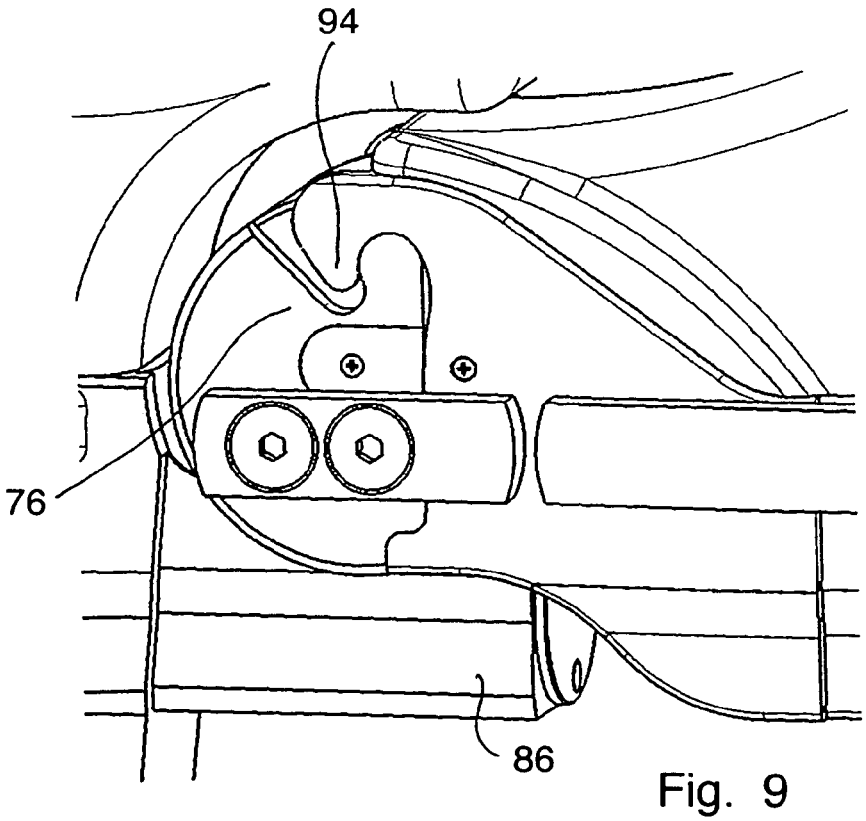
FIG. 9 shows a partially perspective arrangement of the coupling elements of the second interface which are in engagement with one another.
Figure 10:
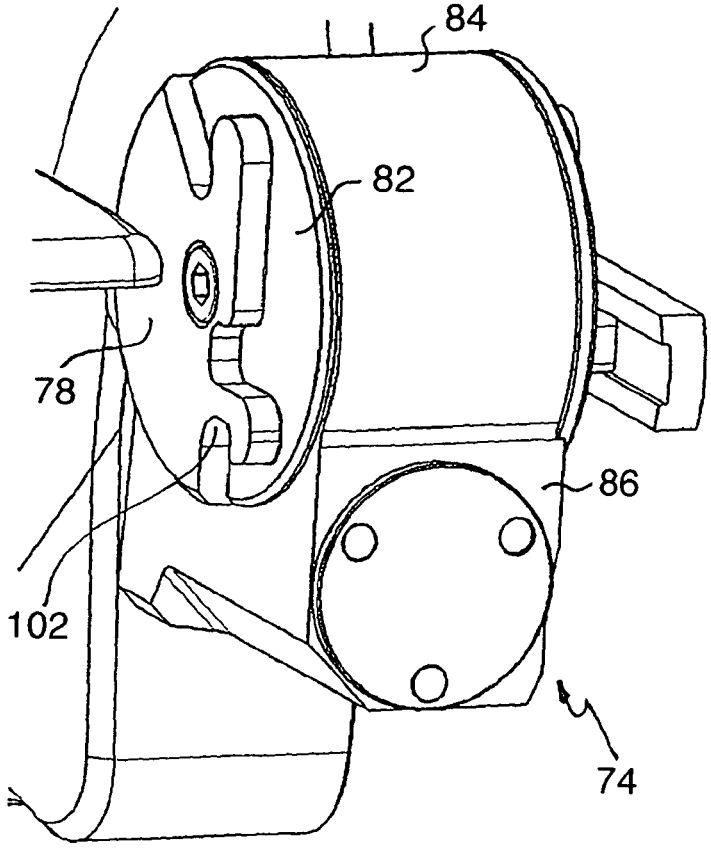
FIG. 10 shows the adjustable coupling element, arranged on the intermediate portion, of the second interface, including its actuating drive, alone.
Figure 11:
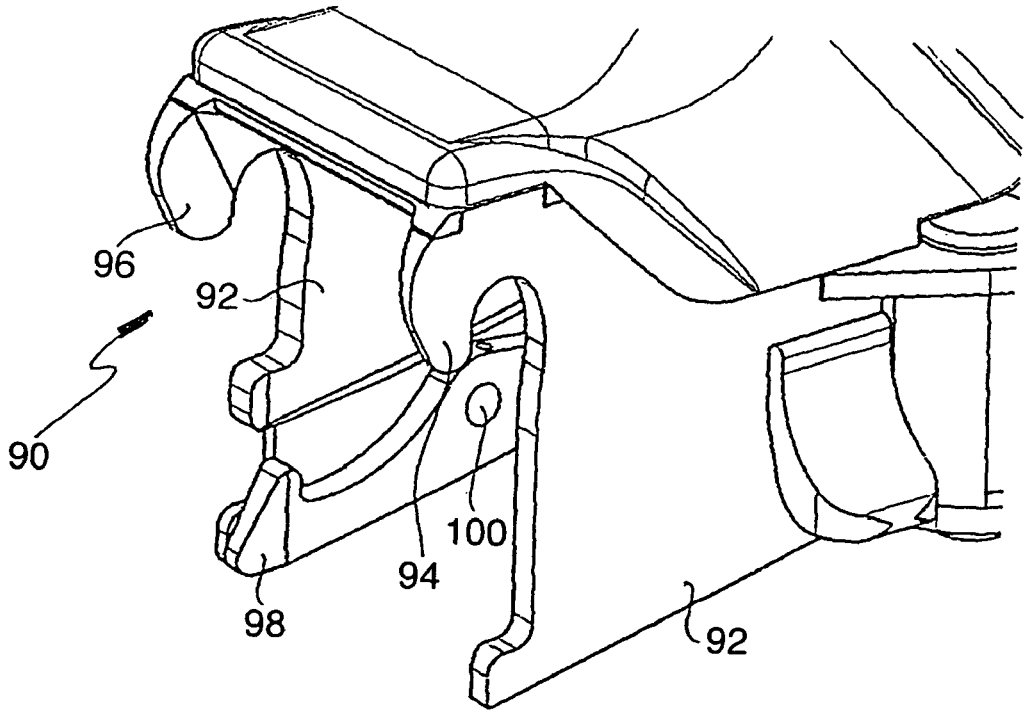
FIG. 11 shows a perspective illustration of the coupling element, arranged on the further bed portion, of the second interface, alone.

The countercoupling element 90, assigned to the coupling element 74, on the further bed portion 70 is formed by two flat end portions of a spar 92 of the bed portion 70 which are provided with hooks 94 and 96 complementary to the hook receptacles 76 and 78. When the hooks 94 and 96 are suspended in the hook receptacles 76 and 78, the two spar portions enclose the gear case 84 between them, as shown in FIG. 9. For interlocking the two coupling elements 74 and 90 of the second interface 68, there is an interlocking hook 98 which is mounted on the spar 92 pivotably about an axis 100 and into which a clearance 102 formed on the inner hook receptacle 78 snaps when the two coupling elements 74 and 90 are in engagement with one another. This interlocking hook 98 can be lifted out of the clearance 102 in a way not illustrated when the coupling elements are to be released from one another.

The above description shows that the coupling elements of the second interface 68 and the coupling elements of the first interface 30 are not compatible with one another. The bed portion 70 or 72 can therefore be connected only to the driven coupling elements 74 of the intermediate portion 32, but not to the coupling elements 34 or 36 of the first interface 30. The coupling elements 74 of the intermediate portion 32 can be coupled just as little to the coupling elements 34 of the middle portion 18. The intermediate portion 32 can therefore be combined with the middle portion 18 in one predetermined position only. This avoids the portions of the bed being assembled in a configuration which is not intended.

Figure 7:
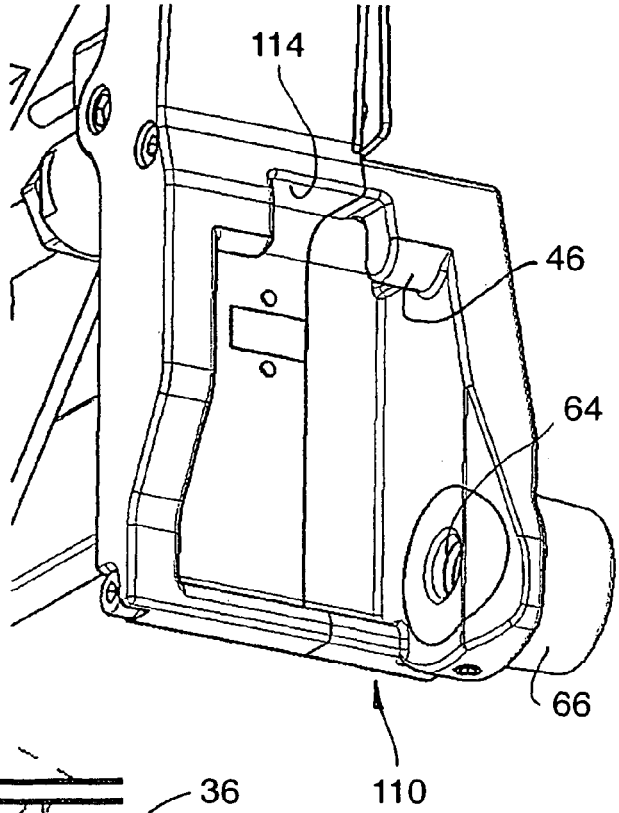
FIG. 7 shows an illustration, corresponding to FIG. 4, of the coupling element, arranged on an accessory part, of the third interface.
Figure 6:
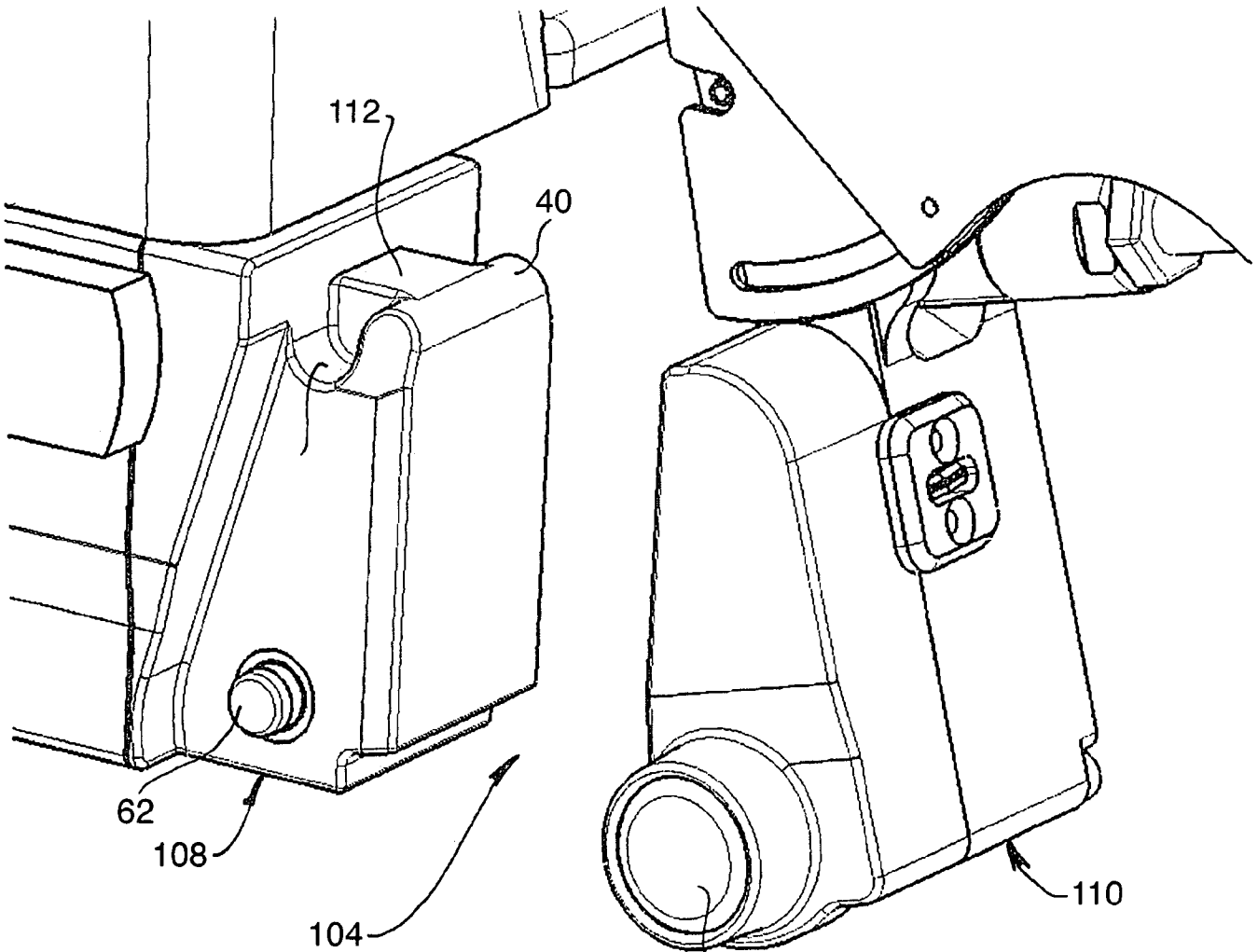
FIG. 6 shows a perspective illustration of the coupling elements of the third interface which are intended for mutual engagement with one another.
Figure 8:
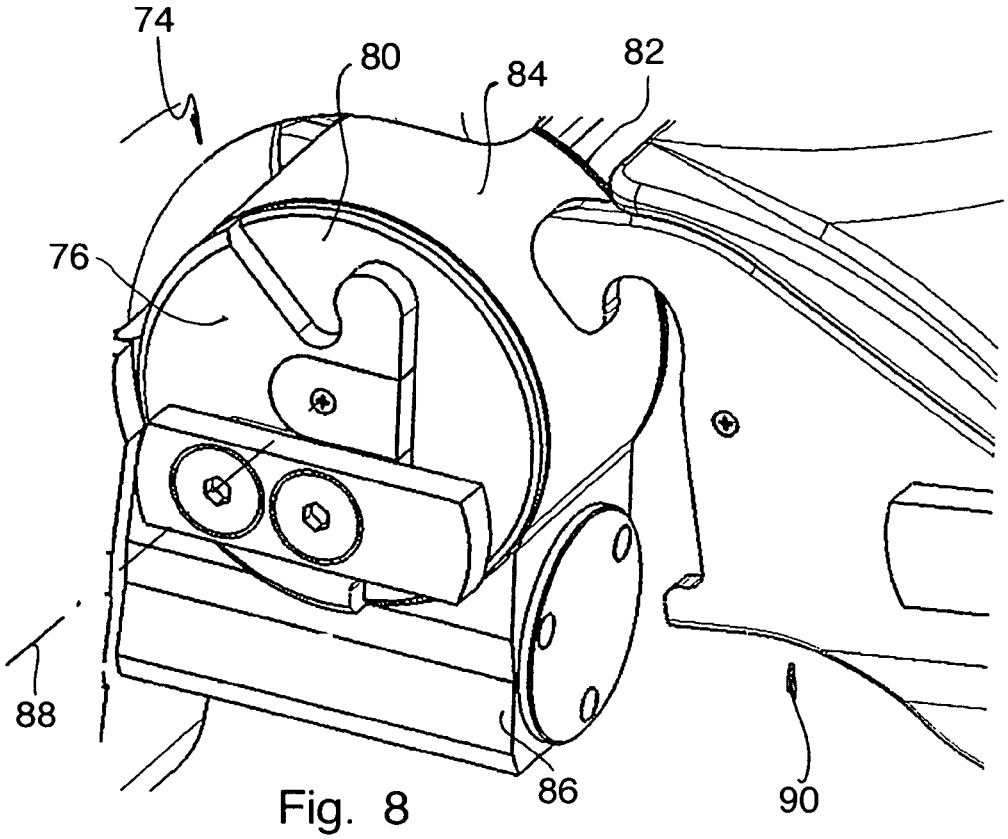
FIG. 8 shows a partially diagrammatic illustration of the coupling elements of the second interface which are intended for mutual engagement with one another.

The further bed portion 70, which is illustrated here as a back plate, can also be coupled, at its end facing away from the intermediate portion 32, via a third interface 104 (FIG. 1), to a further bed part 106, for example a head plate. To describe the coupling elements of the third interface 104, reference is made to FIGS. 6 and 7. FIG. 6 shows a coupling element 108 arranged on the bed portion 70 and a coupling element 110 which is arranged on the bed portion 106 and the inside of which can be seen in FIG. 7. From a comparison with FIGS. 3 and 4, it can be seen that the coupling elements 108, 110 are identical to the coupling elements 34 and 36, with the exception that the channel-shaped hook receptacle 42 of the coupling element 108 has arranged in it centrally a block 112 to which a complementary clearance 114 in the bead 46 of the coupling element 110 corresponds. The result of this is that, although the coupling element 110 can be suspended in a coupling element 34, arranged on the middle portion 18, of the first interface 30, the coupling element 36, arranged on the intermediate portion 32, of the first interface cannot be suspended in a coupling element 108 of the bed portion 70. The former case has been illustrated in FIG. 1, in which a bed portion 106, instead of an intermediate portion 32, has been coupled directly on the left of the middle portion 18. Such coupling is allowed by the special design of the coupling elements of the first and of the third interface.

A further difference between the coupling elements 108 and 110 and the coupling elements 34, 36 is that, in the former, no contacts for the transmission of signals and/or energy are provided.

As can be seen, the coupling elements of all the interfaces are designed such that, in any situation relevant to the operation to be carried out, the load is transmitted via the positive connection. The interlock is never loaded in a pivoting range of 90° upwards and downwards out of the middle position.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A patient bed for an operating table, comprising a plurality of bed portions that are substantially aligned along a single common plane when arranged in a substantially horizontal configuration, of which a middle portion is designed for connection to a supporting column of the operating table and which are coupled releasably to one another via interfaces, at least one bed portion being adjustable in relation to an adjacent bed portion in the region of an interface, wherein the middle portion of the bed is connectable at at least one of its ends, via a first interface, to one end of an intermediate portion which is connectable at its other end, via a second interface, to a further bed portion, wherein the first interface has two first coupling elements which engage positively one in the other for a rigid connection and which have transmission elements coming into contact with one another during interengagement and intended for transmission of signals and/or energy, and wherein the second interface comprises two second coupling elements which are intended for positive engagement with one another and one of the second coupling elements which is arranged on the intermediate portion can be adjusted, by means of an actuating drive arranged on the intermediate portion, about an axis parallel to the bed plane and perpendicular to the bed longitudinal direction.

2. The patient bed according to claim 1, wherein the coupling elements of the interfaces which are in engagement with one another are interlockable by means of a positive interlock.

3. The patient bed according to claim 1, wherein the coupling elements of the two interfaces are not mutually compatible.

4. The patient bed according to claim 1, wherein at least one further bed portion, which can be coupled to the intermediate portion via the second interface, is coupleable at its other end, via a third interface, to an accessory part.

5. The patient bed according to claim 4, wherein the third interface comprises third coupling elements engaging positively one in the other.

6. The patient bed according to claim 1, wherein the actuating drive comprises a threaded worm driven by a motor and a worm wheel driven by the threaded worm, and the adjustable second coupling element is connected fixedly in terms of rotation to the worm wheel.

7. A patient bed for an operating table, comprising a plurality of bed portions, of which a middle portion is designed for connection to a supporting column of the operating table and which are coupled releasably to one another via interfaces, at least one bed portion being adjustable in relation to an adjacent bed portion in the region of an interface, wherein the middle portion of the bed is connectable at at least one of its ends, via a first interface, to one end of an intermediate portion which is connectable at its other end, via a second interface, to a further bed portion, wherein the first interface has two first coupling elements which engage positively one in the other for a rigid connection and which have transmission elements coming into contact with one another during interengagement and intended for transmission of signals and/or energy, and wherein the second interface comprises two second coupling elements which are intended for positive engagement with one another and one of the second coupling elements which is arranged on the intermediate portion can be adjusted, by means of an actuating drive arranged on the intermediate portion, about an axis parallel to the bed plane and perpendicular to the bed longitudinal direction, wherein, in the case of both interfaces, in each case one of the coupling elements is provided with at least one hook and the other coupling element with at least one complementary hook receptacle.

8. A patient bed for an operating table, comprising a plurality of bed portions, of which a middle portion is designed for connection to a supporting column of the operating table and which are coupled releasably to one another via interfaces, at least one bed portion being adjustable in relation to an adjacent bed portion in the region of an interface, wherein the middle portion of the bed is connectable at at least one of its ends, via a first interface, to one end of an intermediate portion which is connectable at its other end, via a second interface, to a further bed portion, wherein the first interface has two first coupling elements which engage positively one in the other for a rigid connection and which have transmission elements coming into contact with one another during interengagement and intended for transmission of signals and/or energy, and wherein the second interface comprises two second coupling elements which are intended for positive engagement with one another and one of the second coupling elements which is arranged on the intermediate portion can be adjusted, by means of an actuating drive arranged on the intermediate portion, about an axis parallel to the bed plane and perpendicular to the bed longitudinal direction, wherein at least one further bed portion, which can be coupled to the intermediate portion via the second interface, is coupleable at its other end, via a third interface, to an accessory part, wherein the third interface comprises third coupling elements engaging positively one in the other, and wherein the third coupling elements are designed such that the accessory side third coupling element is compatible with the first coupling element arranged on the middle portion, and the third coupling element arranged on the further bed portion is incompatible with the first coupling element arranged on the intermediate portion.

9. A patient bed for an operating table, comprising a plurality of bed portions, of which a middle portion is designed for connection to a supporting column of the operating table and which are coupled releasably to one another via interfaces, at least one bed portion being adjustable in relation to an adjacent bed portion in the region of an interface, wherein the middle portion of the bed is connectable at at least one of its ends, via a first interface, to one end of an intermediate portion which is connectable at its other end, via a second interface, to a further bed portion, wherein the first interface has two first coupling elements which engage positively one in the other for a rigid connection and which have transmission elements coming into contact with one another during interengagement and intended for transmission of signals and/or energy, and wherein the second interface comprises two second coupling elements which are intended for positive engagement with one another and one of the second coupling elements which is arranged on the intermediate portion can be adjusted, by means of an actuating drive arranged on the intermediate portion, about an axis parallel to the bed plane and perpendicular to the bed longitudinal direction, wherein the middle portion comprises two segments which are pivotable relative to one another about a pivot axis directed transversely to the longitudinal direction of the bed.

* * * * *